United States Patent [19]

Mandai et al.

[11] Patent Number: 4,543,553

[45] Date of Patent: Sep. 24, 1985

[54] CHIP-TYPE INDUCTOR

[75] Inventors: Harufumi Mandai, Takatsuki; Kunisaburo Tomono, Kyoto, both of Japan

[73] Assignee: Murata Manufacturing Co., Ltd., Japan

[21] Appl. No.: 610,682

[22] Filed: May 16, 1984

[30] Foreign Application Priority Data

May 18, 1983 [JP] Japan ..... 58-75679[U]

[51] Int. Cl.[4] ..... H01F 17/04

[52] U.S. Cl. ..... 336/83; 29/602 R; 336/200; 336/232

[58] Field of Search ..... 336/200, 232, 192, 221, 336/83; 361/412, 414; 29/602 R, 851, 830, 853, 606

[56] References Cited

U.S. PATENT DOCUMENTS

| | | | |
|---|---|---|---|
| 3,765,082 | 10/1973 | Zyetz | 336/200 X |
| 3,812,442 | 5/1974 | Muckelroy | 336/200 X |
| 3,833,872 | 9/1974 | Marcus et al. | 336/200 X |

FOREIGN PATENT DOCUMENTS

| | | | |
|---|---|---|---|
| 3022347 | 12/1981 | Fed. Rep. of Germany | 336/200 |
| 2379229 | 1/1977 | France | 336/200 |
| 55-67158 | 5/1980 | Japan | 336/200 |
| 57-100209 | 1/1982 | Japan . | |
| 58-10810 | 1/1983 | Japan . | |
| 772528 | 4/1957 | United Kingdom | 336/200 |

*Primary Examiner*—Thomas J. Kozma

*Attorney, Agent, or Firm*—Ostrolenk, Faber, Gerb & Soffen

[57] ABSTRACT

A present invention is a chip-type inductor comprising a laminated structure (28) of a plurality of magnetic layers (1 to 8) in which linear conductive patterns (9 to 21) extending between the respective magnetic layers are connected successively in a form similar to a coil so as to produce an inductance component. The conductive patterns (12, 14, 16, 18, 20, 11 and 10) formed on the upper surfaces of the magnetic layers and the conductive patterns (9, 13, 15, 17, 19 and 21) formed on the lower surfaces of the magnetic layers are connected with each other in the interfaces of the magnetic layers and are also connected each other via through-holes (22 to 27) formed in the magnetic layers, so that the conductive patterns are continuously connected in a form similar to a coil.

10 Claims, 7 Drawing Figures

CHIP-TYPE INDUCTOR

BACKGROUND OF THE INVENTION

The present invention relates to a chip-type inductor comprising a laminated structure of a plurality of magnetic layers in which linear conductive patterns extending between the magnetic layers are continuously connected in a form similar to a coil so as to produce an inductance component, and more particularly relates to a chip-type inductor in which the manner of connection of the conductive patterns is improved.

In manufacturing a chip-type inductor of the foregoing type, the manner of interconnection of the linear conductive patterns extending between the magnetic layers becomes important. More particularly, in order to successively connect the linear conductive patterns in a form similar to a coil, an arrangement must be provided to connect one conductive pattern to another through each magnetic layer.

One prior art solution to this problem is to form a linear conductive pattern on a magnetic layer, and then to form a second magnetic layer by printing on the first magnetic layer with the linear conductive pattern being partially exposed, and then to form a subsequent conductive pattern on the second magnetic layer by printing so that the subsequent pattern is in contact with the previously formed conductive pattern and then a further magnetic layer and a further conductive pattern are similarly formed, and thus, magnetic layers and conductive patterns are successively printed to form a laminated structure.

However, this prior art has disadvantages in that as the printing process is employed, printing patterns must be changed each time the design is changed, which is not suitable for production of small numbers of different types of patterns.

In another example of the prior art, through-holes are formed in the magnetic layers and by means of each of the through-holes, conductive patterns vertically adjacent to each other are connected. This prior art is described for example in Official Gazette of Japanese Utility Model Application Disclosure No. 100209/1982 in which conductive patterns are formed only on the upper surfaces of the respective magnetic layers and through-holes are formed in the regions where the conductive patterns are formed, a conductive pattern formed on the upper surface of one magnetic layer and a conductive pattern formed on the upper surface of another magnetic layer under the above stated magnetic layer being connected with each other by means of a conductive material filling in each through-hole.

However, in this prior art, since the through-holes are filled with a conductive material, it sometimes happens that the conductive material extends to the lower surface of a magnetic layer where a conductive pattern is not formed and accordingly, such a lower surface is stained with the conductive material, the characteristics of manufactured inductors varying from inductor to inductor. In addition, precise positioning between the through-holes and the conductive patterns is strictly required in the above stated prior art, which makes it difficult to make electrical connection in a perfect condition.

SUMMARY OF THE INVENTION

Therefore, it is an object of the present invention to provide a chip-type inductor which can solve the above described problems involved in the prior art.

According to the present invention, conductive patterns vertically adjacent to each other are connected via a through-hole. The present invention has a characteristic feature in the connection of the conductive patterns existing between the magnetic layers and accordingly, originality is developed in the formation of conductive patterns and the positioning of through holes.

More specifically, a chip-type inductor in accordance with the present invention comprises a laminated structure of n magnetic layers (n being a natural number of four or more), and linear conductive patters extending between the magnetic layers are successively connected in a form similar to a coil to produce an inductance component. In these n magnetic layers, a conductive pattern is formed on the lower surface of the uppermost first magnetic layer and respective conductive patterns are formed on the upper surfaces of the lowermost nth magnetic layer and the adjacent n−1th magnetic layer. On each of the second to the n−2th magnetic layers, conductive patterns are formed on both of the upper and lower surfaces. The conductive pattern on the lower surface of each of the first through n−2th magnetic layers is in contact with the conductive pattern on the upper surface of second through n−1th magnetic layers, respectively, such that the conductive patterns on immediately adjacent faces of these magnetic layers are in contact with one another. In each of the second to the n−1th magnetic layers, a through-hole is formed in a region where no conductive pattern is formd thereon, and through each respective through-hole, the conductive pattern formed on the upper surface of the magnetic layer located immediately below that through-hole is electrically connected to the conductive pattern formed on the lower surface of the magnetic layer immediately above that through-hole. As a result, the conductive patterns formed on the respective surfaces are connected, successively in an order following the conductive patterns on the upper surface of the nth magnetic layer, the lower surface of the n−2th magnetic layer, the upper surface of the n−1th magnetic layer, the lower surface of the n−3th magnetic layer, and so on so that the conductive patterns thus connected extend like a coil. To both ends of the sequence of conductive patterns thus connected respective lead-out conductors are electrically connected whereby the inductance component is lead out to the exterior.

According to the present invention, if a large number of magnetic layers having the same conductive pattern are prepared in advance, the design of an inductor can be changed by simply selecting an appropriate number of magnetic layers at the time the laminated structure is formed. Such a manufacturing process is suitable for production of small numbers of various types of inductor designs. Through-holes as described above are provided in the magnetic layers at a location removed from the conductive patterns formed in the magnetic layers, and since the conductive patterns positioned on the upper and lower surfaces, respectively, of every other magnetic layer is connected via a through-hole in the intervening magnetic layer, it is not necessary to fill each through-hole with a conductive material, which makes it possible to solve the above stated problems of undesirable contamination of a part of the magnetic layers by the conductive material. In addition, since the conductive patterns are in a state completely enclosed in the magnetic material after the formation of a laminated structure of magnetic layers, a closed magnetic circuit is formed, which prevents leakage of magnetic flux, and accordingly this structure serves to protect the neighboring circuits from any magnetic influence. Furthermore, a high value of Q can be obtained.

DESCRIPTION OF THE PREFERRED EMBODIMENTS

Figure 1:
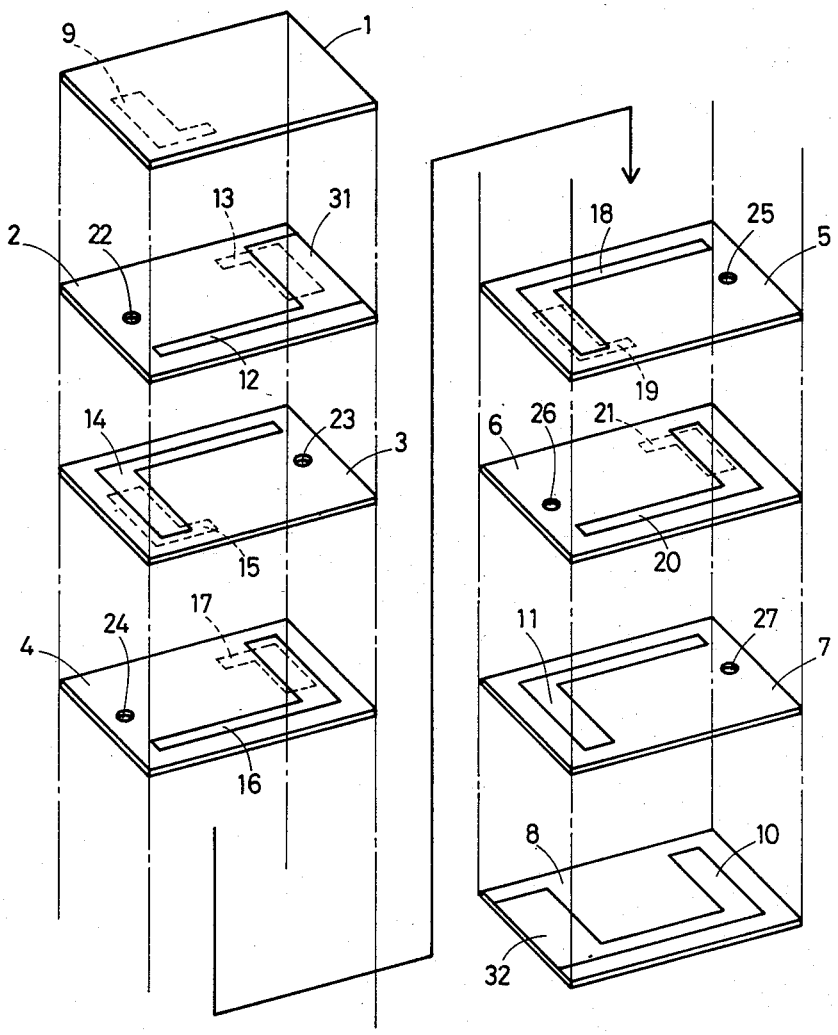
FIG. 1 is a perspective view showing in a disassembled state the respective magnetic layers constituting a embodiment of the present invention.

FIG. 1 is a perspective view showing in a disassembled state magnetic layers constituting an embodiment of the present invention. In this embodiment, eight (n=8) magnetic layers 1 to 8 are employed. Among these magnetic layers 1 to 8, the uppermost first magnetic layer 1 is provided with an L-shaped conductive pattern 9 formed in on the lower surface thereof and the lowermost eighth (nth) magnetic layer 8 and the adjacent seventh (n−1th) magnetic layer 7 are provided with respective L-shaped conductive patterns 10 and 11 formed on the upper surfaces of the layers 8 and 7. The second to the sixth (the 2nd to the n−2th) magnetic layers 2 to 6 are provided respectively with L-shaped conductive patterns 12 and 13; 14 and 15; 16 and 17; 18 and 19; and 20 and 21 formed on the upper and lower surfaces of the layers 2 to 6.

In the second to the seventh (the 2nd to the n−1th) magnetic layers 2 to 7, through-holes 22 to 27 are formed respectively in a region where no conductive pattern is formed in each layer.

The magnetic layers 1 to 8 in FIG. 1 are placed one upon another in the vertical relation shown in the drawing. This laminated state is partially shown in FIG. 2 where the magnetic layer 2 provided with the through-hole 22 is shown in the center and the magnetic layers 1 and 3 are placed over and under the layer 2, respectively. In the process described below, magnetic layers are prepared and then laminated together. As a magnetic material for forming the magnetic layers, ferrite for example is used. Ferrite may be Ni-Zn ferrite, Ni-Cu-Sn ferrite, Mg-ZN ferrite, Cu-Zn ferrite and the like and these materials make it possible to obtain an electrical resistivity of at least 1 MΩ-cm or more. The magnetic layers formed of such magnetic material are placed one upon another and then subjected to a heating and pressing process and a sintering process, so that a laminated structure is obtained as a complete unit.

Figure 2:
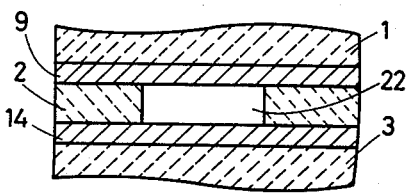
FIG. 2 is an enlarged sectional view showing the area surrounding a through hole 22 when the layers of the inductor of the present invention have been placed together but have not yet been pressed together.
Figure 3:
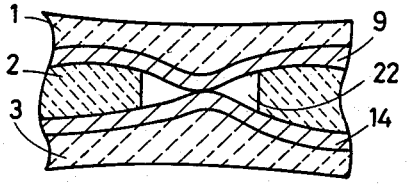
FIG. 3 is a sectional view showing a state obtained by applying pressure to the portion shown in FIG. 2.

In the above stated heating and pressing process, the portion shown in FIG. 2 is deformed as shown in FIG. 3. More specifically, the peripheral portions of the through-hole 22 are slightly crushed and the upper and lower magnetic layers 1 and 3 are deformed to be plunged into the through-hole 22 so that the conductive patterns 9 and 14 formed on the magnetic layers 1 and 3, respectively, are in contact with each other. Thus, the conductive pattern 9 and the conductive pattern 14 are electrically connected. Electrical connections between the conductive patterns of every other magnetic layer are attained in similar manner via the through-hole formed in the intervening magnetic layer.

Figure 4:
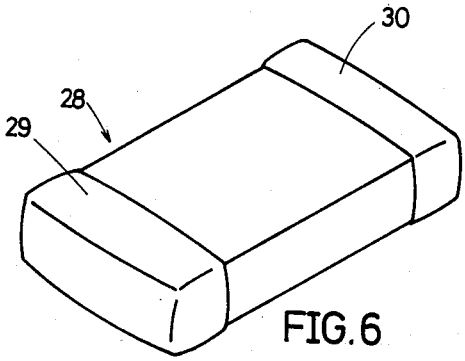
FIG. 4 is a perspective view showing a chip-type inductor obtained by forming a laminated structure comprising the magnetic layers shown in FIG. 1.

A laminated structure 28 thus obtained is shown in FIG. 4. On both ends of the laminated structure 28, external electrodes 29 and 30 are formed. The external electrodes 29 and 30 are obtained in a manner where suitable metallic paste is painted on the laminated structure 28 after the structure has been sintered and then undergoes a firing process. As a material for forming the above described conductive patterns, which are to be subjected to the sintering process of the magnetic layers, a metal of high melting point such as silver-palladium, palladium, gold is preferably used. The conductive patterns are formed by printing such a metallic paste. By contrast, it is not necessary for the external electrodes to be formed of a metal having a high melting point.

As shown in FIG. 1, the conductive pattern 12 formed on the upper surface of the second magnetic layer 2 extends to the right side in the drawing, where a lead-out conductor 31 is formed. The conductive pattern 10 formed on the upper surface of the eighth magnetic layer 8 extends to the left side in the drawing, where a lead-out conductor 32 is formed. These lead-out conductors 31 and 32 are connected respectively to the external electrodes 30 and 29.

Figure 5:
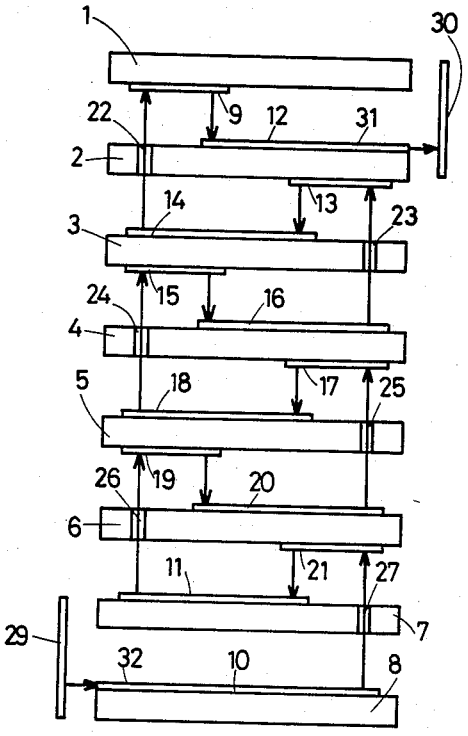
FIG. 5 illustrates the manner of connecting conductive patterns etc. in the chip-type inductor in FIG. 4.

FIG. 5 illustrates the order of connection of the conductive patterns 9 to 21 formed on the respective magnetic layers 1 to 8. In FIG. 5, the magnetic layers 1 to 8 and the external electrodes 29 and 30 are shown in exploded form for the purpose of clarifying the positional relation of the conductive patterns.

Referring to FIG. 5, the order of connection from the external electrode 29 to the other external electrode 30 will now be described. The arrows in FIG. 5 represent electrical connection of the portions joined by these arrows, and the direction of each arrow shows the connecting direction starting from the external electrode 29.

First, the external electrode 29 is connected to the lead-out conductor 32. The conductive pattern 10 continued from the lead-out conductor 32 is connected to the conductive pattern 21 through the through-going hole 27. In other words, the conductive pattern formed on the upper surface of the magnetic layers 3–8 and the conductive pattern formed on the lower surface of the magnetic layers 1–5 are connected through a respective through-holes. Then, the conductive pattern 21 becomes in contact with the conductive pattern 11, and the conductive pattern 11 is connected to the conductive pattern 19 through the through-hole 26. Subsequently, connection between respective electrodes is made in the same manner, and the order of connection can be easily understood by following the arrows and the conductive patterns. Finally, the conductive pattern 12 is connected to the external electrode 30 through the lead-out conductor 31.

In the present invention, as described above in conjunction with the embodiment, the number of magnetic layers may be any number of four or more. Specifically stated with reference to FIGS. 1 and 5, if only four magnetic layers, i.e. the magnetic layer 8, the magnetic layer 7, the magnetic layer 2 and the magnetic layer 1 are placed one upon another to form a laminated structure, the conductive patterns 10, 13, 11, 9 and 12 extend in this order like a coil so that a chip-type inductor can be structured. In addition, the magnetic layers 3 to 6 are structured in exactly the same manner regarding the relative relations in the formation of conductive patterns and the positioning of through-holes, and accordingly, if a sequence of such magnetic layers 3 to 6 is further provided repeatedly, a chip-type inductor having a larger number of turns can be obtained.

In the embodiment shown in the drawings, the plane form of each magnetic layer is rectangular and a conductive pattern on the upper surface of a magnetic layer is formed along one long side and one short side of a rectangle and a conductive pattern on the lower surface of a magnetic layer is formed along the other long side and the above stated one of short sides of a rectangle, a through-hole being formed in a position near the other short side, which brings about an advantage in that precise positioning of the through-holes is not strictly required. In other words, even when the conductive patterns are in the shape of the letter L, a sufficient width is allowed for the region in a conductive pattern associated with a through-hole and accordingly even if the position of a through-hole deviates, the conductive patterns existing over and under this hole can be made securely in contact with each other through this hole. In addition, the position of each through-hole need not be immediately adjacent one side of each magnetic layer, and accordingly, the strength of each magnetic layer can be enhanced and the manufacturing process can be facilitated.

In the above described embodiment, a magnetic layer was regarded as an element for obtaining a single chip-type inductor and therefore, conductive patterns and through-holes were also formed with a view to obtaining such a single chip-type inductor. However, in a sheet of magnetic material, which is to be cut afterwards, conductive patterns and through-holes may be formed in an arrangement adapted for obtaining a number of chip-type inductors. Thus, if the sheet of magnetic material is cut properly, a large number of chip-type inductors can be obtained at the same time.

Figure 6:
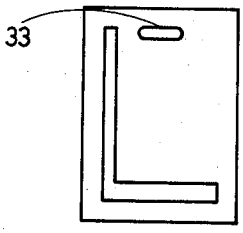
FIGS. 6 and 7 are plan views, respectively, showing variants of through-holes which may be employed in the present invention.
Figure 7:
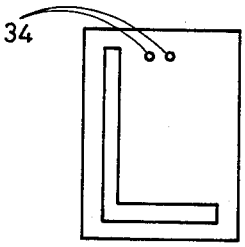

The through-holes to be applied in the present invention are not limited to the circular holes as shown in FIG. 1 and may be oval as in case of a through hole 33 shown in FIG. 6 or in any other shape, or two through-holes 34, as shown in FIG. 7, or more than two through-holes may be disposed side by side.

Although the present invention has been described and illustrated in detail, it is clearly understood that the same is by way of illustration and example only and is not to be taken by way of limitation, the scope of the present invention being limited only by the terms of the appended claims.

What is claimed is:

1. A chip-type inductor comprising a laminated structure of n magnetic layers, n being a natural number greater than or equal to 4, where linear conductive patterns extending between the magnetic layers are connected successively in a form similar to a coil so as to produce an inductance component, characterized in that:

of the n magnetic layers, the uppermost first magnetic layer is provided with a conductive pattern formed on the lower surface thereof and the lowermost nth magnetic layer and the adjacent n−1th magnetic layer are provided with respective conductive patterns on the upper surfaces thereof;

each of the second to the n−2th magnetic layers is provided with a respective pair of conductive patterns, one of the pair being located on the upper surface thereof, the other of the pair being located on the lower surface thereof, each of said second to n=2th magnetic layers insulating its respective pair of conductive patterns from one another;

the conductive pattern formed on the lower surface of the first to the n−2th magnetic layers being in direct contact with the conductive pattern formed on the upper surface of the second to n−1th magnetic layers, respectively;

in each of the second to the n−1th magnetic layers, a respective, electrically non-conductive, through-hole is formed in a region where no conductive pattern is formed in the layer; the conductive pattern formed on the upper surface of the third through nth magnetic layer being connected to the conductive pattern formed on the lower surface of the first through n−2th magnetic layers, respectively, via the through-hole formed in the second through n−1th magnetic layers, respectively; and lead out electrodes are connected to the conductive layers formed on the first and nth electrodes, respectively.

2. A chip-type inductor in accordance with claim 1, wherein each of said magnetic layers is planar and is rectangular in shape as viewed in its plane such that each of the major surfaces of each magnetic layer has first and second short sides and first and second long sides, and wherein the conductive pattern formed on the upper surface of the second through n−1th magnetic layers is formed along the first long side and the first short side of the respective magnetic layer on which it is formed and the conductive pattern formed on the lower surface of the first through n−2th magnetic layers is formed along the second long side and the first short side of the respective magnetic layer in which it is formed, the through-hole formed in the second through n−1th magnetic layers being located in a position along the second short side of the respective magnetic layer in which it is formed.

3. A chip-type inductor in accordance with claim 1, wherein each of said through-holes is circular in shape.

4. A chip-type inductor in accordance with claim 1, wherein each of said through-holes is oval in shape.

5. A chip-type inductor in accordance with claim 1, wherein each of said second through n−1th magnetic layers also has a second through-hole formed therein the two through-holes formed in each respective magnetic layer being located adjacent one another.

6. A chip-type inductor, comprising:

n generally planar magnetic layers, n being a natural number greater than or equal to 4, said magnetic layers being stacked one atop the other to form a stack of magnetic layers;

a conductive pattern formed on the lower surface of the uppermost first magnetic layer and a respective conductive pattern formed on the upper surfaces of the lowermost nth magnetic layer and the adjacent n−1th magnetic layer, respectively;

a respective conductive pattern being formed on the upper surface of the second to n−2th magnetic layers and a respective conductive pattern being formed on the lower surface of each of the second to n−2th magnetic layers, the second to n−2th layers insulating its respective conductive pattern on the upper surface thereof from its respective conductive pattern on the lower surface thereof, the conductive pattern formed on the lower surface of the first to n−2th magnetic layers being in direct contact with the conductive pattern formed on the upper surface of the second to n−1th magnetic layers, respectively;

a respective, electrically non-conductive, through-hole formed in each of said second to n−1th magnetic layers in a region where no conductive pattern is formed in the layer in which the through-hole is formed, the relative locations of said conductive patterns formed on said first to nth conductive layers and the relative locations of said through-holes being such that after said magnetic layers are compressed together by a force extending in a direction generally perpendicular to the plane of said magnetic layers, the conductive pattern formed on the upper surface of the third through nth magnetic layer comes into physical contact with the conductive pattern formed on the lower surface of the first through n−2th magnetic layers, respectively, via the through-hole formed in the second through n−1th magnetic layers, respectively, said conductive patterns being so connected to define a continuous conductor in a form similar to a coil so as to produce an inductance component; and lead out electrodes connected to the conductive layers formed on the first and nth electrodes, respectively.

7. A chip-type inductor in accordance with claim 6, wherein each of said magnetic layers is rectangular in shape as viewed in its plane such that each of the major surfaces of the magnetic layer has first and second short sides and first and second long sides, and wherein the conductive pattern formed on the upper surface of the second through nth magnetic layers is formed along the first long side and the first short side of the respective magnetic layer on which it is formed and the conductive pattern formed on the lower surface of the first through n−2th magnetic layers is formed along the second long side and the first short side of the respective magnetic layer on which it is formed, the through-hole formed in the second through n−1th magnetic layers being located in a position along the second short side of the respective magnetic layer in which it is formed.

8. A chip-type inductor in accordance with claim 6, wherein each of said through-holes is circular in shape.

9. A chip-type inductor in accordance with claim 6, wherein each of said through-holes is oval in shape.

10. A chip-type inductor in accordance with claim 6, wherein each of said second through n−1th magnetic layers also has a second through-hole formed therein, the two through-holes formed in each respective magnetic layer being located adjacent one another.

* * * * *